US008789691B2

(12) United States Patent
Olsen

(10) Patent No.: US 8,789,691 B2
(45) Date of Patent: Jul. 29, 2014

(54) CONTAINER CARRIER

(75) Inventor: Robert C. Olsen, Medinah, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/537,225

(22) Filed: Jun. 29, 2012

(65) Prior Publication Data

US 2013/0048515 A1 Feb. 28, 2013

Related U.S. Application Data

(60) Provisional application No. 61/528,557, filed on Aug. 29, 2011.

(51) Int. Cl.
*B65D 75/00* (2006.01)

(52) U.S. Cl.
USPC ..... 206/150; 206/153

(58) Field of Classification Search
CPC ..... B65D 71/504
USPC ..... 206/150, 151, 158, 148, 149, 153, 159, 206/194, 199, 427; 294/87.2
See application file for complete search history.

(56) References Cited

U.S. PATENT DOCUMENTS

| | | | | |
|---|---|---|---|---|
| 5,018,620 | A * | 5/1991 | Marco et al. | 206/150 |
| 5,806,667 | A | 9/1998 | Marco | |
| 6,148,994 | A * | 11/2000 | Olsen | 206/150 |
| 6,969,098 | B2 * | 11/2005 | Olsen | 294/87.2 |
| 7,510,074 | B2 * | 3/2009 | Weaver et al. | 206/150 |
| 7,793,778 | B2 * | 9/2010 | Olsen | 206/150 |
| 2006/0118432 | A1 | 6/2006 | Weaver et al. | |

FOREIGN PATENT DOCUMENTS

| | | |
|---|---|---|
| EP | 0 997 389 A1 | 5/2000 |
| EP | 1 207 105 A1 | 5/2002 |

* cited by examiner

*Primary Examiner* — David Fidei
(74) *Attorney, Agent, or Firm* — Pauley Petersen & Erickson

(57) ABSTRACT

A flexible carrier for carrying a plurality of containers within a plurality of corresponding container receiving apertures that includes at least two rows of container receiving apertures wherein each container receiving aperture is wider than an adjacent container receiving aperture from a center to outer edges of the carrier wherein a handle extends outwardly from one row of the at least two rows.

14 Claims, 3 Drawing Sheets

CONTAINER CARRIER

CROSS-REFERENCE TO RELATED APPLICATION

This application claims the benefit of U.S. Provisional Patent Application Ser. No. 61/528,557, filed 29 Aug. 2011, the entirety of which application is incorporated herein by reference.

BACKGROUND OF THE INVENTION

Field of the Invention

This invention relates to a container carrier for unitizing a plurality of containers.

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures that each engage a corresponding container may be used to unitize groups of four, six, eight, twelve or other suitable groups of containers into a convenient multipackage. Flexible ring carriers may include a handle that extend upwardly from the carrier to enable a consumer to carry the package from the top (called a "top lift carrier") or outwardly from a side of the carrier to enable a consumer to carry the package from the side (called a "side lift carrier").

Typically, longer carriers tend to sag at the ends when lifted resulting in a sloppy appearance. As such, a need arises for a carrier capable of carrying a large number of containers yet results in an aesthetically pleasing package to the consumer.

SUMMARY OF THE INVENTION

The present invention is directed to a flexible carrier for packaging containers that includes an arrangement of container receiving apertures that are longer as they progress from a center area of the carrier to outer edges of the carrier.

According to preferred embodiments of this invention, each flexible carrier preferably includes two rows of container receiving apertures, each for receiving a container, to form a package. The resulting carrier is configured to result in a tight, unitized bricklike package following application of the carrier to a corresponding array of containers.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
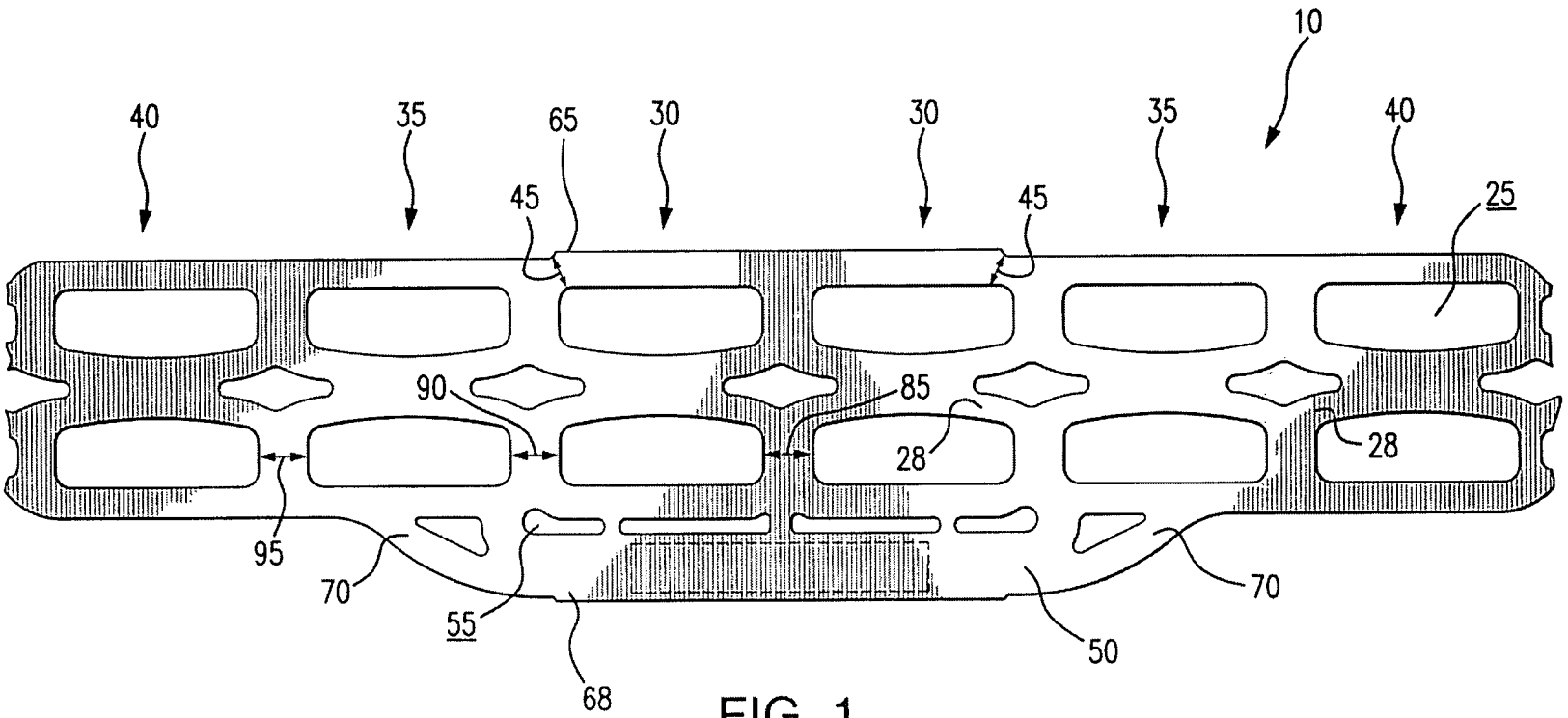
FIG. 1 is a side elevational view of a container carrier according to one preferred embodiment of this invention.
Figure 2:
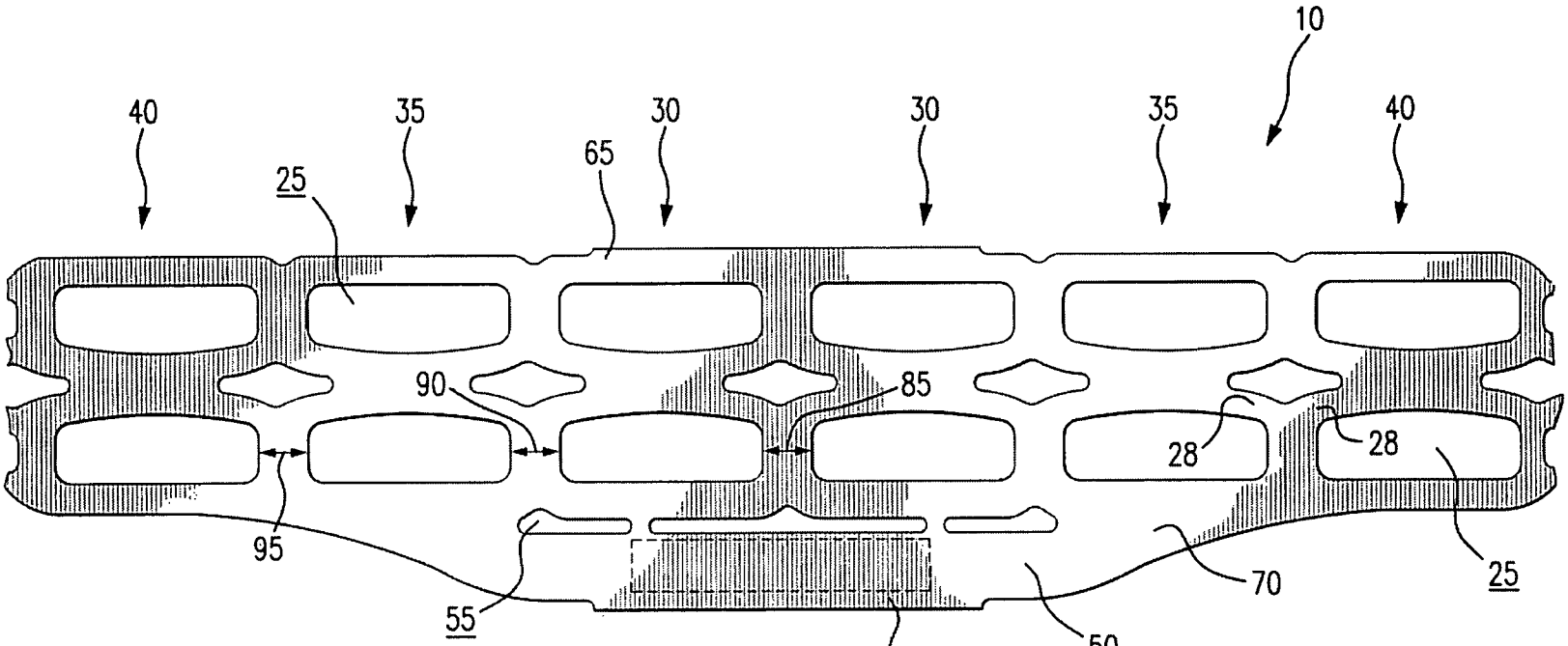
FIG. 2 is a side elevational view of a container carrier according to one preferred embodiment of this invention.
Figure 3:
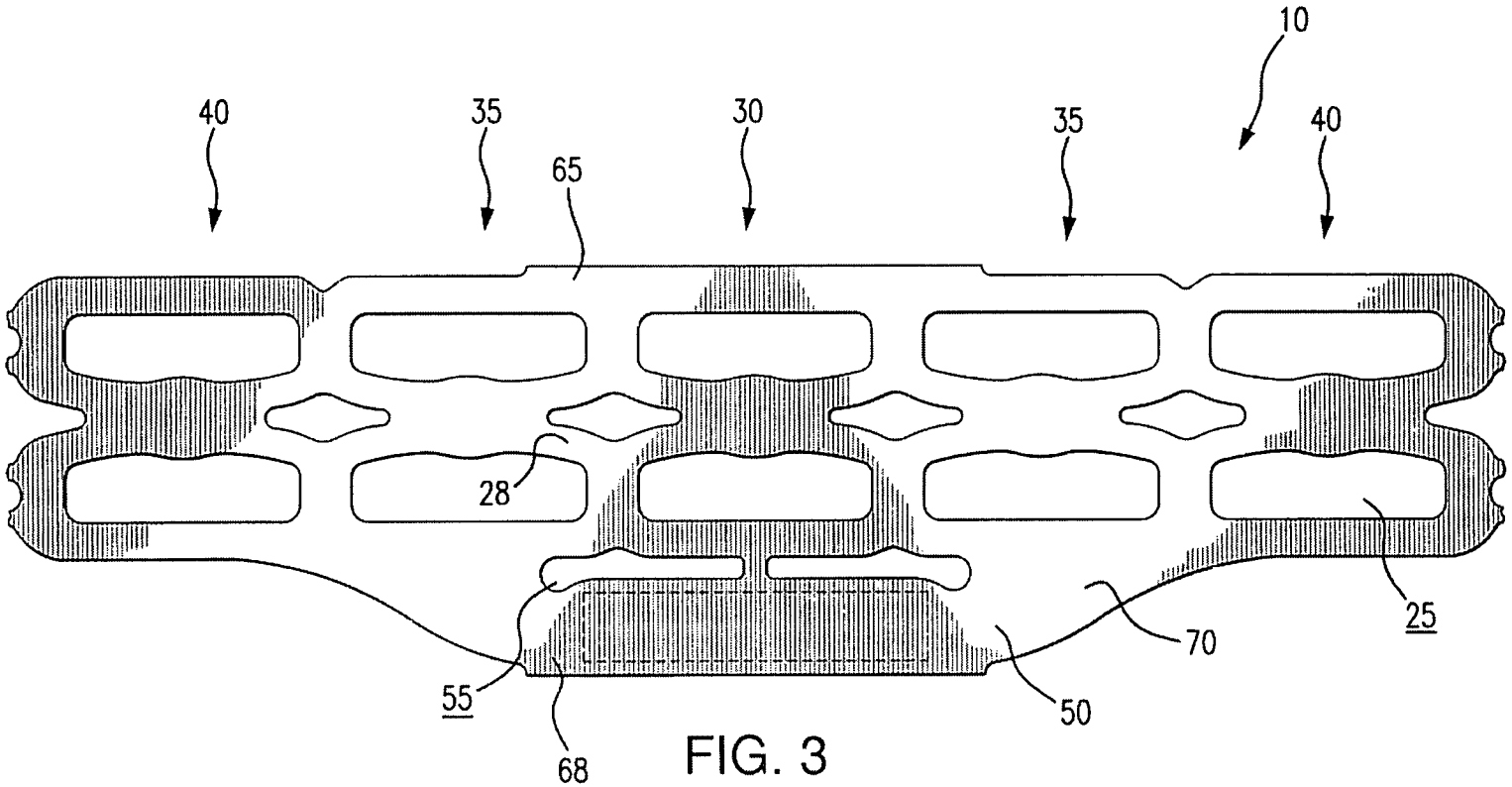
FIG. 3 is a side elevational view of a container carrier according to one preferred embodiment of this invention.

FIGS. 1-3 show flexible carrier 10 for unitizing eight or more containers and a resulting unitized package. Although FIGS. 1-3 illustrate various structures for flexible carrier 10 of the invention, the illustrations are exemplary, and the invention is not limited to the flexible carriers 10 or packages shown. For example, flexible carrier 10 may be alternatively configured and used to unitize ten, fourteen or any other desired number of containers.

Containers are preferably cans, however, bottles or any other commonly unitized container may be used with flexible carrier 10 according to this invention. The containers are preferably, though not necessarily, like-sized within a single flexible carrier 10.

Each flexible carrier 10 preferably includes a single layer of flexible sheet 20 having a width and length defining therein a plurality of container receiving apertures 25, each for receiving a container. The plurality of container receiving apertures 25 are preferably arranged in longitudinal rows and longitudinal ranks so as to form an array of container receiving apertures 25, such as two rows by six ranks for a twelve container multipackage as shown in FIGS. 1 and 2 or two rows by five ranks for a ten container multipackage as shown in FIG. 3. Container receiving apertures 25 are preferably elongated in a longitudinal direction of flexible carrier 10.

As shown in FIGS. 1-3, two parallel rows of container receiving apertures 25 are preferably formed within flexible sheet 20. As such, one row of container receiving apertures 25 is preferably formed along each side of the carrier 10. Container receiving apertures 25 are preferably formed in a geometry that results in a tight unitization of containers without excess play and/or sliding between and among containers and flexible carrier 10. Such a result is difficult when carrier 10 is elongated for eight or more containers as described herein.

As described above, container carrier 10 according to a preferred embodiment of the invention includes a series of interconnecting oblique webs 28 that define the plurality of container receiving apertures 25. Webs 28 are stretchable around container during application and recoverable around container following application.

As described above, the plurality of container receiving apertures 25 are preferably arranged in transverse pairs. As shown in FIGS. 1 and 2, at least two rows forming a plurality of container receiving aperture pairs extend across carrier 10. In particular, carrier 10 preferably includes center pairs 30 in a center area of carrier 10. As shown in FIG. 1, two center pairs 30 are formed central within the six pairs of container receiving apertures 25. Intermediate pairs 35 are formed outward of center pairs 30. Finally, outer pairs 40 are formed at each outer edge of carrier 10, outward of intermediate pairs 35.

As shown in FIGS. 1 and 2, each container receiving aperture 25 in the outer pairs 40 is longer than each container receiving aperture 25 in the intermediate pairs 35 which is longer than each container receiving aperture 25 in the center pairs 30. For example, center pairs 30 may include a length (measured along a longitudinal axis of the carrier) of approximately 2.203", intermediate pairs 35 may include a length approximately 0.050" longer than the center pairs 30 and outer pairs 40 may include a length approximately 0.165" longer than the center pairs 30. As a result, the container receiving apertures 25 are progressively longer than an adjacent container receiving aperture 25 from a center to outer edges of the carrier 10.

According to one preferred embodiment shown in FIG. 1, a lip 65 is formed along a longitudinal periphery of the carrier 10. Preferably, the lip 65 is formed in an area of the center pairs 30 of container receiving apertures 25. More specifically, the lip 65 is formed precisely at an outer corner of one container receiving aperture 25 in each center pair 30 to provide a greater central bandwidth 45. A corresponding ridge 68 is preferably formed along handle 50 and, during the manufacturing process, several adjacent lanes of carriers 10 may be connected between lip 65 and ridge 68.

As shown in FIGS. 1 and 2, a first distance 85 between center pairs 30 of container receiving apertures 25 is the same or shorter than a second distance 90 between center pairs 30 and intermediate pairs 35 of container receiving apertures 25. Further, a third distance 95 between intermediate pairs 35 of container receiving apertures and outer pairs 40 of container receiving apertures is longer than the second distance 90.

As shown in FIGS. 1-3, according to one preferred embodiment of this invention, handle 50 is formed along one row of container receiving apertures 25 along a periphery of plastic sheet 20. Specifically, as shown in FIG. 1, handle 50 is connected along a side of the row of container receiving apertures 25. Handle 50 may be integrally formed with flexible sheet 20 or may be separately incorporated with flexible sheet 20.

Handle 50 may comprise one or more elongated apertures 55 positioned along the outer periphery of handle 50 or may comprise a similar configuration that provides an ample area for a consumer to grasp by inserting his hand through and still maintain the purpose and integrity of package. As shown in FIG. 1, a handle 50 extends from a longitudinal edge of carrier 10. As shown in FIG. 1, handle 50 is attached at four sections along the longitudinal edge of carrier 10. Specifically, handle 50 is attached adjacent the intermediate pairs 35 of container receiving apertures 25. As a result of the attachment in this manner, an elongated package such as two by six or two by five is maintained in a solid bricklike package and not prone to allowing end containers to sag when carried. As best shown in FIGS. 1 and 2, a pair of struts 70 or a single strut connect handle 50 with the rows of container receiving apertures 25.

A package resulting from flexible carrier 10 includes a plurality of unitized containers. Flexible carriers 10 are generally applied to containers by stretching flexible sheet 20 surrounding container receiving apertures 25 around container, and requiring the stretched carrier 10 to recover, thereby providing a tight engagement.

While in the foregoing specification this invention has been described in relation to certain preferred embodiments thereof, and many details have been set forth for purpose of illustration, it will be apparent to those skilled in the art that flexible carrier 10 is susceptible to additional embodiments and that certain of the details described herein can be varied considerably without departing from the basic principles of the invention.

The invention claimed is:

1. A carrier for unitizing a plurality of containers within a plurality of corresponding container receiving apertures, the carrier comprising:

at least two rows each including a plurality of container receiving aperture pairs extending from center pairs to intermediate pairs to outer pairs, wherein in each of the at least two rows each container receiving aperture in the outer pairs is longer than each container receiving aperture in intermediate pairs which is longer than each container receiving aperture in center pairs; and a handle extending from adjacent only one row of the at least two rows.

2. The carrier of claim 1 further comprising a plurality of struts formed between the handle and the only one row.

3. The carrier of claim 1 further comprising a lip formed along a longitudinal periphery of the carrier opposite the handle, the lip formed in an area of the center pairs of container receiving apertures.

4. The carrier of claim 1 further comprising a first distance between center pairs of container receiving apertures which is the same or shorter than a second distance between center pairs and intermediate pairs of container receiving apertures.

5. The carrier of claim 4 further comprising a third distance between intermediate pairs of container receiving apertures and outer pairs of container receiving apertures which is longer than the second distance.

6. A carrier for unitizing a plurality of containers within a plurality of corresponding container receiving apertures, the carrier comprising:

at least two rows of container receiving apertures each formed in five ranks wherein in each row each container receiving aperture is longer than an adjacent container receiving aperture in the each row from a center to outer edges of the carrier; and a handle extending from one longitudinal edge of the carrier and a lip extending from an opposite longitudinal edge of the carrier.

7. The carrier of claim 6 further comprising a plurality of struts formed between the handle and at least one row of container receiving apertures.

8. The carrier of claim 6 wherein the lip is formed in an area of center pairs of container receiving apertures.

9. The carrier of claim 6 wherein the container receiving apertures are arranged in center pairs in a central area of the carrier, intermediate pairs outward of the center pairs, and outer pairs at outer edges of the carrier.

10. The carrier of claim 9 further comprising a first distance between center pairs of container receiving apertures which is shorter than a third distance between intermediate pairs of container receiving apertures and outer pairs of container receiving apertures.

11. A carrier for unitizing a plurality of containers within a plurality of corresponding container receiving apertures, the carrier comprising:

a first row of at least five first row container receiving apertures, wherein each first row container receiving aperture is longer than an adjacent first row container receiving aperture from a center to outer edges of the carrier; and a second row of at least five second row container receiving apertures aligned with the first row, wherein each second row container receiving aperture is longer than an adjacent second row container receiving aperture from the center to the outer edges of the carrier; and a handle extending from adjacent only one row of the at least two rows.

12. The carrier of claim 11, wherein the first row includes at least one first center container receiving aperture disposed between an intermediate pair of the first row container receiving apertures which are disposed between an outer pair of the first row container receiving apertures.

13. The carrier of claim 11 wherein:

the first row includes a first plurality of first row container receiving aperture pairs extending from a first center pair to a first intermediate pair to a first outer pair, wherein each first row container receiving aperture in the first outer pair is longer than each first row container receiving aperture in the first intermediate pair which is longer than each first row container receiving aperture in the first center pair;

the second row includes a second plurality of second row container receiving aperture pairs extending from a second center pair to a second intermediate pair to a second outer pair, wherein each second row container receiving aperture in the second outer pair is longer than each second row container receiving aperture in the second intermediate pair which is longer than each second row container receiving aperture in the second center pair.

14. The carrier of claim 13, wherein the first center pair is disposed between the intermediate pair which is disposed between the first outer pair.

* * * * *